US009211051B2

(12) United States Patent
Billgren et al.

(10) Patent No.: US 9,211,051 B2
(45) Date of Patent: Dec. 15, 2015

(54) DISHWASHER SPRAY ARM WITH SPREADING MEMBER

(75) Inventors: Johan Billgren, Stockholm (SE); Gustav Degerman, Stockholm (SE); Willhelm Leissner, Lidingo (SE); Lisa Warmegard, Stockholm (SE)

(73) Assignee: Electrolux Home Products Corporation N.V., Brussels (BE)

( * ) Notice: Subject to any disclaimer, the term of this patent is extended or adjusted under 35 U.S.C. 154(b) by 180 days.

(21) Appl. No.: 13/698,172

(22) PCT Filed: May 13, 2011

(86) PCT No.: PCT/EP2011/057809

§ 371 (c)(1),
(2), (4) Date: Mar. 25, 2013

(87) PCT Pub. No.: WO2011/144540

PCT Pub. Date: Nov. 24, 2011

(65) Prior Publication Data

US 2013/0206190 A1 Aug. 15, 2013

(30) Foreign Application Priority Data

May 19, 2010 (SE) ..... 1000529

(51) Int. Cl.
*A47L 15/42* (2006.01)
*A47L 15/23* (2006.01)

(52) U.S. Cl.
CPC ..... *A47L 15/4278* (2013.01); *A47L 15/23* (2013.01)

(58) Field of Classification Search
CPC ..... A47L 15/42; A47L 15/78
USPC ..... 134/198; 239/246
See application file for complete search history.

(56) References Cited

U.S. PATENT DOCUMENTS

| | | | | |
|---|---|---|---|---|
| 270,664 | A * | 1/1883 | Henderson et al. | 239/231 |
| 2,585,608 | A | 2/1952 | Wieghart | |
| 3,415,258 | A * | 12/1968 | Gilson | 134/112 |

(Continued)

FOREIGN PATENT DOCUMENTS

| | | |
|---|---|---|
| GB | 973 859 | 10/1964 |
| GB | 1 099 701 | 1/1968 |
| JP | 60-053120 A | 3/1985 |
| JP | 2000 254077 | 9/2000 |
| WO | WO-92/12665 | 8/1992 |
| WO | WO-2011/144540 | 11/2011 |

OTHER PUBLICATIONS

International Search Report for Application No. PCT/EP2011/057809, dated Nov. 10, 2011.

*Primary Examiner* — Michael Barr
*Assistant Examiner* — Rita Adhlakha
(74) *Attorney, Agent, or Firm* — Alston & Bird LLP

(57) ABSTRACT

The present invention relates to a spray arm for distributing wash liquid in a dishwasher. The spray arm extends in a longitudinal direction and comprises at least one nozzle for ejecting wash liquid from the spray arm, wherein at least one spreading member adapted to spread wash liquid ejected from the nozzle is arranged on the spray arm in a vicinity of the nozzle.

15 Claims, 4 Drawing Sheets

(56) References Cited

U.S. PATENT DOCUMENTS

| | | | | |
|---|---|---|---|---|
| 3,915,182 | A * | 10/1975 | Payne | 134/176 |
| 4,066,472 | A | 1/1978 | Perry | |
| 5,031,651 | A * | 7/1991 | Spiegel et al. | 134/183 |
| 5,964,232 | A * | 10/1999 | Chung | 134/176 |
| 7,819,339 | B2 * | 10/2010 | Dieziger | 239/252 |
| 2005/0230502 | A1 * | 10/2005 | Bragg et al. | 239/533.12 |
| 2007/0289615 | A1 | 12/2007 | Shin | |
| 2010/0108102 | A1 * | 5/2010 | Kehl et al. | 134/25.2 |

* cited by examiner

DISHWASHER SPRAY ARM WITH SPREADING MEMBER

CROSS REFERENCE TO RELATED APPLICATIONS

This application is a national stage application filed under 35 U.S.C. 371 of International Application No. PCT/EP2011/057809, filed May 13, 2011, which claims priority from Swedish Patent Application No. 1000529-6, filed May 19, 2010, each of which is incorporated by reference herein in its entirety.

TECHNICAL FIELD

The present invention relates to an arrangement in a dishwasher, more particularly the present invention relates to a spray arm for distributing wash liquid in a dishwasher.

BACKGROUND OF THE INVENTION

In a dishwasher, one or more spray arms are normally arranged to distribute water and/or a mix of water and a washing agent, evenly and efficiently throughout the interior of the dishwasher to clean dishes placed therein. In different phases of a washing program for a dishwasher, the dishes may be soaked, cleansed or rinsed. The use of different water spreading functions depends on what phase the washing program is going through. For example, water being spread without significant force may be used for soaking the dish and to soften dirt and soil. Water being spread with a strong beam of ejected water may be used to remove dirt with force from the dishes.

The number of nozzles on a spray arm as well as the size of the nozzles may be varied in order to achieve different spray patterns and/or water spreading functions. It is known in the prior art to adjust the nozzle size on a spray arm to achieve different spray patterns. However, adjustments of the nozzle shape and/or size resulting in a thinner nozzle opening often results in clogged nozzles. This is clearly a drawback as clogged nozzles result in a poor dish cleaning result.

As may be realized from the above, there is a need for improvements in the field of spray arms for dishwashers.

SUMMARY OF THE INVENTION

It is an object of the present invention to ameliorate or overcome at least one of the drawbacks of the prior art.

A further object with the present invention is to provide a spray arm for a dishwasher with improved spray functions and/or spray pattern.

This object is achieved by the provision of a spray arm for distributing wash liquid in a dishwasher. The spray arm extends in a longitudinal direction and comprises at least one nozzle for ejecting wash liquid from the spray arm, wherein at least one spreading member adapted to spread washing liquid ejected from the nozzle is arranged on the spray arm in a vicinity of the nozzle.

An advantage with the provision of the spreading member is the enhanced coverage zone. The coverage zone, i.e. the covered area, with respect to forcing washing liquid to the dishes inside the dishwasher, will be greater with the spreading member arranged on the spray arm compared to a nozzle on a spray arm without the spreading member. Further, the spreading member adds to the driving force of the spray arm, reducing the numbers of required dedicated driving nozzles. By reducing the number of driving nozzles, the required amount of water or wash liquid in the dishwasher may be reduced without affecting the dish cleaning result. Further, the spreading member also provides a possibility to adjust the spray pattern by adjusting the velocity and/or pressure of the ejecting liquid. Hence, an improved spray arm for a dishwasher is provided in accordance with at least one of the above mentioned objects.

According to an embodiment of the invention, the spreading member is arranged directly outside the nozzle.

By providing a spreading member which spreads the washing liquid ejected from the nozzle outside the nozzle, the nozzle itself need not care for the spreading function. Therefore, it is a further advantage that the size of the nozzles may be kept at a size at which there is no or at least little risk that the nozzles are clogged.

According to another embodiment of the invention, the nozzle is adapted to eject wash liquid substantially perpendicular to the longitudinal direction of the spray arm.

According to another embodiment of the invention, the spreading member comprises an angled surface extending over and above the nozzle, and wherein the angled surface is adapted to be hit by wash liquid ejecting from the nozzle.

A simple but accurate and effective design of the spreading member makes the provision of spreading members to a spray arm to a favourable contribution to enhanced properties of the spray arm.

According to an embodiment of the invention, the spreading member is arranged on the spray arm of an angle $\alpha$ ranging between 15-80 degrees in relation to the longitudinal direction of the spray arm.

The angle $\alpha$ between the spreading member and the surface of the spray arm may be chosen in order to achieve different spray results. Generally, a relatively large $\alpha$-value results in less spreading of the wash liquid and a stronger beam of wash liquid, while a small $\alpha$-value results in more spreading of the wash liquid, and naturally less power in the beam of wash liquid. The power in an ejected beam of wash liquid is distributed over the surface of the spreading member, and therefore it has more power left when the $\alpha$-value is large and the spreading is moderate.

According to a further embodiment of the invention, the spreading member is an integrated part of the spray arm.

By providing the spreading member as an integrated part of the spray arm, the manufacturing of a spray arm provided with at least one spreading member is simplified as it may be carried out in a single process. It is an advantage that the spray arm with the spreading member(s) may be moulded in one piece.

According to another embodiment of the invention, the spreading member comprises a first portion arranged on the spray arm and a second portion removably attached to the first portion.

In this way a large flexibility is achieved as the spreading member can be exchanged if it has been damaged for some reason or it can be removed completely. Further, the first portion may be integrally moulded together with the spray arm as it may be of the same material as the spray arm. The second portion, which may be of another material, may be provided separately.

According to still another embodiment, the first portion is provided with a slot for receiving the second portion.

According to another embodiment of the invention, the second portion is flexible and adapted to deflect under the influence from wash liquid of a predefined threshold pressure ejected from the nozzle.

By providing the second portion of the spreading member as a flexible portion, still further spray patterns may be achieved. In this way both spread wash liquid and an unaffected beam of wash liquid may be achieved from the some nozzle. At relatively low pressures, the wash liquid will be spread. By increasing the pressure of the ejected wash liquid the flexible second portion will deflect and the spreading decreases.

According to another embodiment of the invention, at least a part of the second portion of the spreading member is adapted to deflect from an undeflected position to an angle α of up to 90 degrees in relation to the longitudinal direction of the spray arm.

In this way, as the spreading member deflects up to almost 90 degrees, the beam ejected from the nozzle will pass the spreading member practically unaffected by it. At certain water pressures, the spreading member will contribute in spreading the liquid, while at higher pressures the spreading member may deflect such that ejected liquid is not spread. This gives a single nozzle the ability to both spread the wash liquid and to provide sufficient mechanical force with an unaffected beam of wash liquid to remove sticky soil from the dishes.

According to a further embodiment of the invention, the spray arm comprises at least two nozzles, and wherein at least one of the nozzles is provided with the spreading member.

By arranging a spray arm both with nozzles provided with a spreading member and nozzles without a spreading member, a variety of spray pattern and/or functions may be achieved. Such a spray arm will contribute to an improved dish cleaning result.

A further aspect of the invention relates to a dishwasher provided with a spray arm in accordance with any one of the above embodiments.

The expression "wash liquid" as used herein refers to the liquid that circulates in a dishwasher during a washing program, which liquid may be water or water mixed with a washing detergent.

BRIEF DESCRIPTION OF THE DRAWINGS

The present invention will hereinafter be further explained by means of non-limiting examples with reference to the appended figures wherein.

DETAILED DESCRIPTION OF PREFERRED EMBODIMENTS

The invention will, in the following, be exemplified by embodiments. It should however be realized that the embodiments are included in order to explain principles of the invention and not to limit the scope of the invention, defined by the appended claims.

Figure 1:
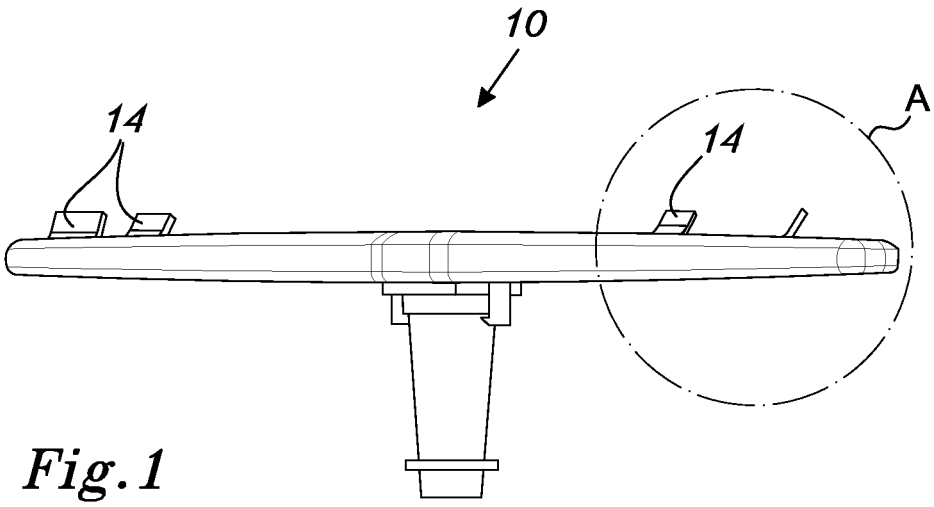
FIG. 1 is a side view of a spray arm for a dishwasher according to an embodiment of the invention.

In FIG. 1 a spray arm 10 for distributing wash liquid in a dishwasher is shown. The spray arm 10 extends in a longitudinal direction and comprises spray nozzles 12 through which the washing liquid is ejected from the spray arm substantially perpendicular to the longitudinal direction of the spray arm. On the spray arm, in a vicinity of the nozzles, spreading members 14 are arranged. The washing liquid ejected through a nozzle provided with a spreading member will be spread out from the spreading member as the ejected beam of wash liquid hits the surface of the spreading member.

Figure 2A:
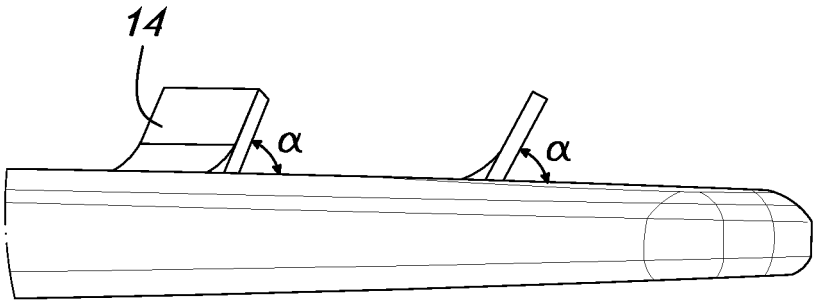
FIG. 2*a-b* show a portion of the spray arm according to the area indicated with A in FIG. 1.

As may be seen in FIG. 2*a*, the spreading member 14 is an angled surface that extends over and above the nozzle 12. The spreading member 14 may be manufactured of rigid material, such as polypropylene (PP). It may be manufactured of the same material as the spray arm itself. The spreading member may be an integrated part of the spray arm and integrally moulded with the spray arm at the manufacturing of the spray arm. The spreading member may have a flat surface facing the nozzle for the liquid to disperse on. Depending on the desired spray image, the surface may as well be concave. By providing a flat or slightly concave surface for the liquid to disperse on, an even spray pattern is achieved.

Figure 2B:
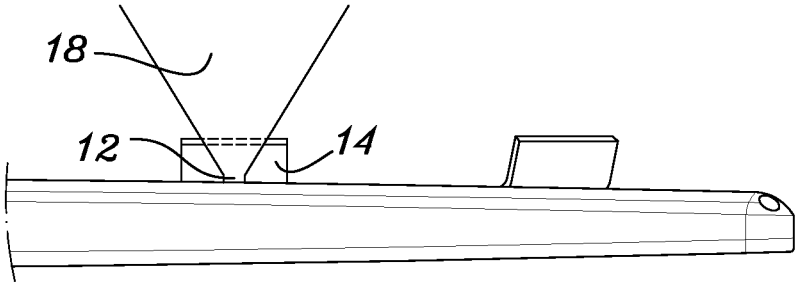

The angle α between the spray arm and the spreading member may be varied preferably between 15-80 degrees, and even more preferably between 40-75 degrees. The size of the angle α is chosen depending on where about on the spray arm 10 the particular spreading member 14 is positioned in relation to what spray area it is supposed to cover and if it is intended to contribute with a driving force to the spray arm. In FIG. 2*b* it is schematically shown how a beam of washing liquid 18 is spread as it hits the spreading member 14. Depending on the pressure of the ejected liquid and the α-value, the spray pattern may be varied as the pressure varies depending on what phase of the wash program the dishwasher goes through.

Figure 3:
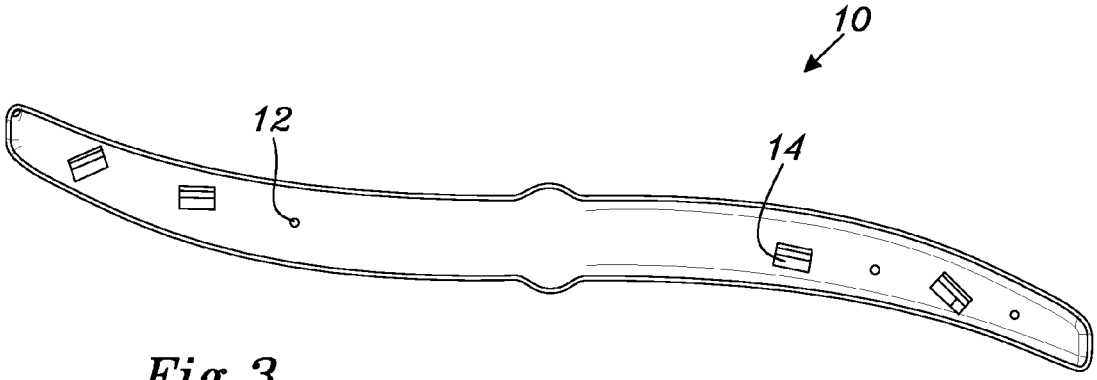
FIG. 3 is a view from above of the spray arm of FIG. 1.

In FIG. 3 the spray arm 10 is shown from above and it can be seen that four of the nozzles 12 on the spray arm are provided with spreading members 14. On the spray arm 10 there are also some nozzles 12 that have no spreading member arranged to them. In this way a varied spray pattern may be achieved that includes both water and/or wash liquid being spread to cover all possible areas of the dishwasher achieved by means of the spreading members. But the spray pattern also includes water being spread by nozzles without a spreading member, which nozzles are particularly useful when a rather high water pressure is used in order to make use of a strong beam of ejected water or wash liquid that may be used to remove dirt with force from the dishes.

Figure 4:
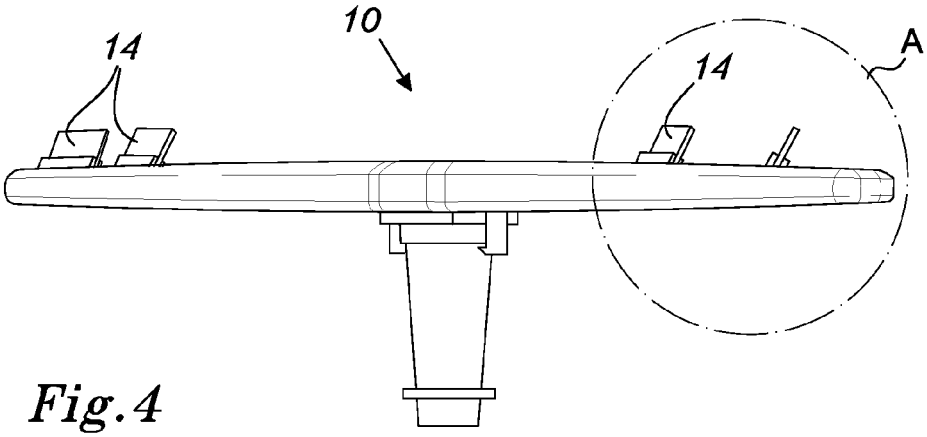
FIG. 4 illustrates a side view of a spray arm for a dishwasher according to another embodiment of the invention.

FIG. 4 illustrates another embodiment of a spray arm for distributing wash liquid in a dishwasher. As in the previously described embodiment, the spray arm 10 comprises spray nozzles 12 through which the washing liquid is ejected from the spray arm. On the spray arm, in the vicinity of the nozzles, spreading members 14 are arranged. In this embodiment, the spreading members comprise a first portion 14*a* and a removably mounted second portion 14*b*.

Figure 5A:
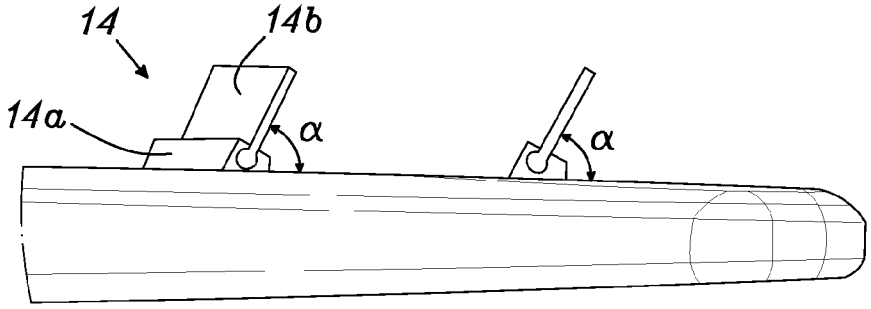
FIG. 5*a-b* show a portion of the spray arm according to the area indicated with A in FIG. 4.
Figure 5B:
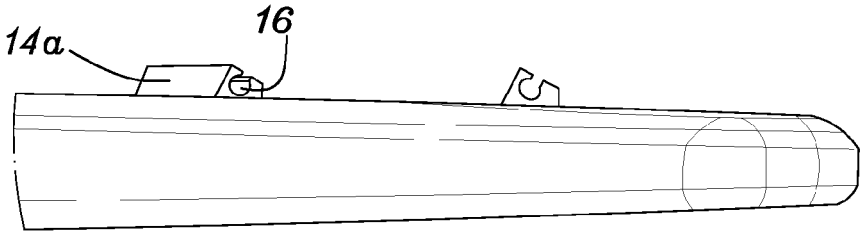

FIGS. 5*a* and 5*b* show an enlarged portion of the spray arm 10. In FIG. 5*a* the first and second portion of the spreading member is shown and in FIG. 5*b* the second portion has been removed. The second portion 14*b* of the spreading member is arranged to the first portion 14*a* by means of a groove 16 in the first portion 14*a*. The second portion 14*b* is made of a flexible material, such as a rubber material. The angle α between the spray arm and the spreading member may be varied preferably between 15-80 degrees, and even more preferably between 40-75 degrees. The spreading member 14 is optimized by choosing thickness and spring constant of the second portion 14*b* for achieving the desired spray pattern in relation to the water or wash liquid pressure in the dishwasher. High pressures on the wash liquid allows the main part of the wash liquid beam to pass the spreading member without being dispersed while the spreading member covers the entire area of the ejected beam at low pressures dispersing all liquid in the beam of wash liquid. This is further explained in relation to FIGS. 7*a-b* below.

Figure 6:
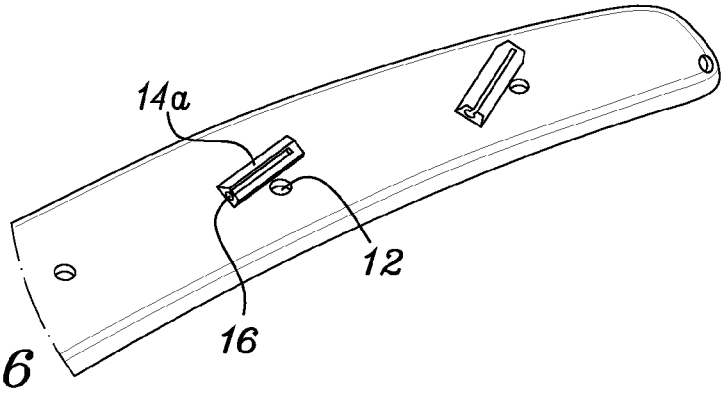
FIG. 6 is a perspective view from above of a portion of the spray arm according to FIG. 4.

In FIG. 6 it may be seen how the first portion 14*a* of the spreading member 14 is arranged in the vicinity of and outside the nozzle 12. A spreading member may be arranged anywhere around the circumference of the nozzle depending on the aimed spray pattern. On the spray arm 10 the may also be nozzles to which no spreading member 14 is arranged.

Figure 7A:
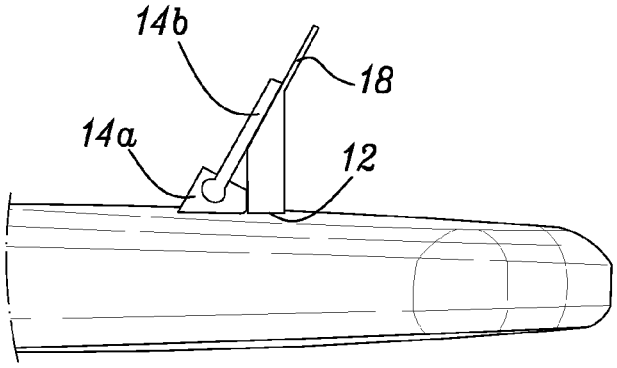
FIG. 7*a-b* show a portion of the spray arm according to the area indicated with A in FIG. 4.
Figure 7B:
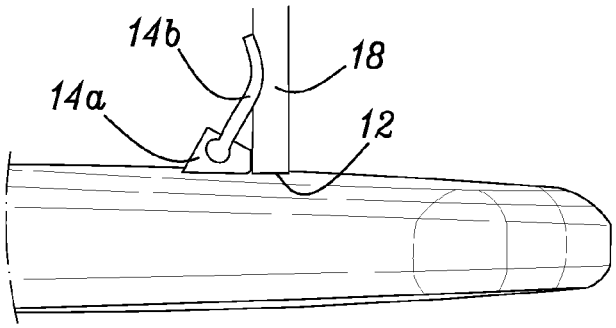

In FIGS. 7*a* and 7*b* it is shown how the beam of ejected wash liquid 18 hits the spreading member 14. In FIG. 7*a* the wash liquid is spread out from the spreading member 14 as the pressure of the ejected wash liquid is relatively low. In FIG. 7*b* the pressure of the ejected liquid is higher than is the case in FIG. 7*a*. Accordingly, in FIG. 7*b* the flexible second portion 14*b* of the spreading member deflects, from an undeflected position, due to the high pressure of the ejected liquid to an angle of up to 90 degrees in relation to the longitudinal direction of the spray arm. At high pressures on the ejected wash liquid, the beam of liquid 18 may pass the spreading member 14 unaffected or almost unaffected by the spreading member as the flexible second member 14*b* is adapted to deflect. The second portion 14*b* is adapted to deflect under the influence from wash liquid of a predefined threshold pressure ejected from the nozzle 12. The conditions are slightly different depending on if the spray arm is mounted as the lower spray arm or as the upper spray arm. For example, on the lower spray arm the flexible second portion 14*b* is optimized for a pressure interval of 50-130 mbar, where different pressures give different degrees of dispersion of the wash liquid. At a pressure of approximately 100 mbar, the flexible second portion starts to deflect. On the upper spray arm the flexible second portion 14*b* is optimized for a pressure interval of 20-75 mbar, where different pressures give different degrees of dispersion of the wash liquid. On the upper spray arm, the flexible second portion starts to deflect upon influence by the out flowing wash liquid at a pressure of approximately 55 mbar. However, the predefined threshold pressure may further vary from one spray arm to another depending on for example its size and what kind on dishwasher it is intended for.

Figure 8:
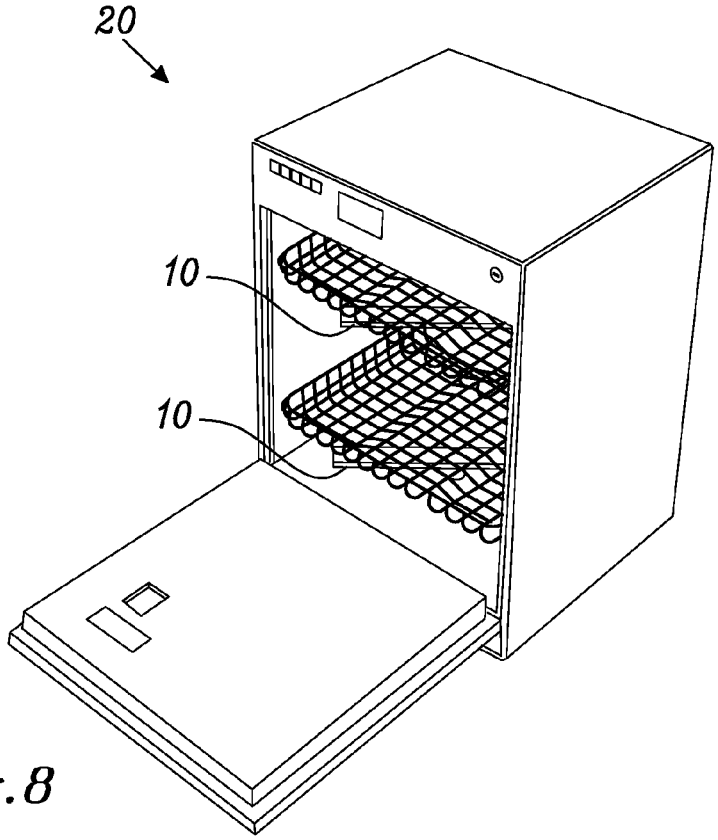
FIG. 8 shows a dishwasher provided with at least one spray arm in accordance with the invention.

A spray arm 10 in accordance with any of the described embodiments may be provided in a dishwasher. In FIG. 8 it is shown a dishwasher for household use provided with an upper as well as a lower spray arm 10. As may be realized, a spray arm 10 according to any of the described embodiments may be installed in another type of dishwasher than the one shown in FIG. 8.

It is to be understood that the foregoing is illustrative of various example embodiments and is not to be limited to the specific embodiments disclosed and that modifications to the disclosed embodiments, combinations of features of disclosed embodiments as well as other embodiments are intended to be included within the scope of the appended claims.

The invention claimed is:

1. A rotatable spray arm for distributing wash liquid in a dishwasher, the spray arm extending in a longitudinal direction and comprising:

at least one nozzle configured to eject the wash liquid from the spray arm at a first angle in relation to the longitudinal direction of the spray arm, and at least one fixed spreading member adapted to spread the wash liquid ejected from the nozzle, wherein the at least one fixed spreading member is arranged on the spray arm in a vicinity of the nozzle and downstream of the nozzle, wherein the at least one fixed spreading member is rigidly attached on top of the spray arm at a predetermined second angle $\alpha$ ranging between 15-80 degrees in relation to the longitudinal direction of the spray arm, and wherein the first angle is different than the second angle; and wherein at least a portion of the at least one spreading member is integrally molded with the spray arm.

2. Spray arm according to claim 1, wherein the spreading member is arranged directly outside the nozzle.

3. Spray arm according to claim 1, wherein the nozzle is adapted to eject the wash liquid substantially perpendicular to the longitudinal direction of the spray arm.

4. Spray arm according to claim 1, wherein the spreading member comprises a surface extending over and above the nozzle, and wherein the surface is adapted to be hit by the wash liquid ejecting from the nozzle.

5. Spray arm according to claim 4, wherein the at least one spreading member is adapted to direct the ejected wash liquid towards the second angle when the ejected wash liquid is below a predetermined pressure.

6. Spray arm according to claim 5, wherein the at least one spreading member is adapted to spread the wash liquid ejected from the nozzle in a direction perpendicular to the second angle.

7. Spray arm according to claim 1, wherein the entirety of the at least one spreading member is an integrated part of the spray arm.

8. Spray arm according to claim 1, wherein the spreading member comprises a first portion arranged on the spray arm and a second portion removably attached to the first portion.

9. Spray arm according to claim 8, wherein the first portion is provided with a slot for receiving the second portion.

10. Spray arm according to claim 8, wherein the second portion is flexible and adapted to flex under the influence from the wash liquid of a predefined threshold pressure ejected from the nozzle.

11. Spray arm according to claim 10, wherein at least a part of the second portion of the spreading member is adapted to flex from an undeflected position to a non-zero angle $\alpha$ of up to 90 degrees in relation to the longitudinal direction of the spray arm.

12. Spray arm according to claim 1, wherein the spray arm comprises at least two nozzles, and wherein at least one of the nozzles is provided with the spreading member.

13. Dishwasher provided with a spray arm in accordance with claim 1.

14. Spray arm according to claim 1, wherein the at least one spreading member is arranged on the spray arm separate from the nozzle such that the at least one spreading member and the nozzle are adjacent each other on the surface of the spray arm.

15. Spray arm according to claim 1, wherein the at least one spreading member defines a substantially planar surface extending over and above the nozzle, and wherein the substantially planar surface is adapted to be hit by the wash liquid ejecting from the nozzle.

* * * * *